US012779617B2

(12) United States Patent
Kwon

(10) Patent No.: US 12,779,617 B2
(45) Date of Patent: Nov. 3, 2026

(54) CHEMICAL MECHANICAL POLISHING (CMP) APPARATUS

(71) Applicant: Samsung Electronics Co., Ltd., Suwon-si (KR)

(72) Inventor: Donghoon Kwon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 666 days.

(21) Appl. No.: 18/144,711

(22) Filed: May 8, 2023

(65) Prior Publication Data

US 2024/0157502 A1 May 16, 2024

(30) Foreign Application Priority Data

Nov. 11, 2022 (KR) ..... 10-2022-0151012

(51) Int. Cl.

| | |
|---|---|
| ***B24B 37/005*** | (2012.01) |
| ***B24B 37/04*** | (2012.01) |
| ***B24B 37/20*** | (2012.01) |
| ***B24B 49/12*** | (2006.01) |

(52) U.S. Cl.

CPC ..... *B24B 37/005* (2013.01); *B24B 37/044* (2013.01); *B24B 37/205* (2013.01); *B24B 49/12* (2013.01)

(58) Field of Classification Search

CPC ... B24B 37/005; B24B 37/044; B24B 37/205; B24B 49/12

See application file for complete search history.

(56) References Cited

U.S. PATENT DOCUMENTS

| | | | | |
|---|---|---|---|---|
| 6,159,073 | A * | 12/2000 | Wiswesser | B24B 37/04 451/6 |
| 6,364,744 | B1 * | 4/2002 | Merchant | C09K 3/1463 451/6 |
| 6,875,088 | B2 * | 4/2005 | Matsui | B24B 37/24 451/526 |
| 7,029,374 | B2 * | 4/2006 | Chen | B08B 7/0035 257/E21.228 |
| 7,071,108 | B2 * | 7/2006 | Matsui | C09G 1/02 438/692 |
| 7,579,071 | B2 * | 8/2009 | Huh | B29C 70/606 51/296 |
| 7,775,852 | B2 | 8/2010 | Birang et al. | |
| 10,076,825 | B2 * | 9/2018 | Takenouchi | B24D 7/06 |
| 10,343,255 | B2 | 7/2019 | Kobata et al. | |
| 10,734,240 | B2 * | 8/2020 | Liu | H01L 21/6715 |

(Continued)

FOREIGN PATENT DOCUMENTS

| | | | |
|---|---|---|---|
| KR | 1020150144952 | A | 12/2015 |
| KR | 1020190054523 | A | 5/2019 |
| KR | 102091419 | B1 | 3/2020 |

*Primary Examiner* — Michael Leslie

(74) *Attorney, Agent, or Firm* — Muir Patent Law, PLLC

(57) ABSTRACT

This disclosure relates to a chemical mechanical polishing apparatus, and may include: a polishing platen including an opening; a polishing pad positioned on the polishing platen and including a transmissive part overlapping the opening; a slurry supply supplying a slurry including a photocatalyst to the polishing pad; a head part positioned on the polishing pad and capable of mounting a wafer; and a light irradiation part positioned within the opening of the polishing platen.

20 Claims, 14 Drawing Sheets

(56) References Cited

U.S. PATENT DOCUMENTS

| | | | | |
|---|---|---|---|---|
| 11,752,592 | B2 * | 9/2023 | Liao | B24B 53/017 451/28 |
| 2009/0053976 | A1 | 2/2009 | Roy et al. | |
| 2019/0022820 | A1 | 1/2019 | Kimba et al. | |
| 2021/0354262 | A1 | 11/2021 | Satori et al. | |

* cited by examiner

CHEMICAL MECHANICAL POLISHING (CMP) APPARATUS

CROSS-REFERENCE TO RELATED APPLICATION

This application claims priority to and the benefit of Korean Patent Application No. 10-2022-0151012 filed in the Korean Intellectual Property Office on Nov. 11, 2022, the entire contents of which are incorporated herein by reference.

BACKGROUND

1. Field

The technical idea of this disclosure relates to a chemical mechanical polishing (CMP) apparatus. More particularly, this disclosure relates to a chemical mechanical polishing apparatus capable of improving a polishing speed of a wafer and dispersion control.

2. Description of the Related Art

A chemical mechanical polishing (CMP) apparatus is to be used in a polishing process to planarize the surface of a semiconductor wafer. In general, semiconductor devices are manufactured by selectively or repeatedly performing processes such as photolithography, etching, diffusion, chemical vapor deposition (CVD), ion implantation, or metal deposition on a wafer. In this process, the semiconductor wafer may undergo a chemical mechanical polishing (CMP) process such as a planarization or etchback process to facilitate the formation of a circuit or other pattern on the surface.

The CMP process supplies a slurry to the surface of a polishing pad that is rotated at a high-speed so as to uniformly distribute the slurry, and positions the surface of the semiconductor wafer (or layer thereon), which requires planarization, close to the surface of the polishing pad to process the target surface of the semiconductor wafer by a chemical action due to the slurry and a physical action due to high-speed rotation.

In the CMP process, research on process control technologies such as pressure, speed, or temperature is in progress, but in the structure of general CMP facilities, in order to respond to an increase in process difficulty along with an increase in a difficulty level for a semiconductor product technology development, additional introduction of existing process control measuring instruments is required.

The above information disclosed in this Background section is only for enhancement of understanding of the background of the described technology, and therefore it may contain information that does not form the prior art that is already known in this country to a person of ordinary skill in the art.

SUMMARY

One of the technical objects to be solved by this disclosure is to provide a chemical mechanical polishing apparatus that includes an additional process control technology using light to respond to an increasing process difficulty along with an increasing difficulty in the semiconductor product technology development.

A chemical mechanical polishing apparatus according to an embodiment of this disclosure may include: a polishing platen including an opening; a polishing pad positioned on the polishing platen and including a transmissive part overlapping the opening; a slurry supply supplying a slurry including a photocatalyst to the polishing pad; a head part located on the polishing pad and capable of mounting a wafer; and a light irradiation part positioned within the opening of the polishing platen. In an embodiment, the head part and the light irradiation part may be rotatable, the rotation direction of the head part may be the same as the rotation direction of the light irradiation part, and the rotation speed of the head part may be the same as the rotation speed of the light irradiation part.

In another embodiment, a protection member located between the polishing platen and the polishing pad may be further included. In another embodiment, the entire (or substantially all of the) protection member may be transparent. In another embodiment, the protection member may include a transmissive region and a supporting region that are alternately disposed in a form of a concentric circle.

In an embodiment, the light irradiation part may include a plurality of regions, and a light amount may be controlled for each of a plurality of regions. In an embodiment, a plurality of regions may be divided in a form of at least one of straight, circular, and radial.

In an embodiment, the entire polishing pad may be transparent. In an embodiment, the photocatalyst may include at least one among $Au/TiO_2$, $TiO_2/SeO_2$, $TiO_2/SiO_2$, $TiO_2$, ZnO, $ZrO_2$, CdSe, $WO_3/TiO_2$, and $Al_2O_3/ZrO_2$. In an embodiment, the light irradiated from the light irradiation part may pass through the transmissive part and reach the wafer mounted on the head part.

A chemical mechanical polishing apparatus according to another embodiment of this disclosure may include: a polishing platen including an opening; a polishing pad positioned on the polishing platen and including a transmissive part overlapping the opening; a slurry supply supplying a slurry including a photocatalyst to the polishing pad; a head part positioned on the polishing pad and capable of mounting a wafer; and a light irradiation part positioned within the opening of the polishing platen, wherein a protection member positioned between the polishing platen and the polishing pad may be further included. In an embodiment, the entire protection member may be transparent.

In an embodiment, the protection member may include a transmissive region and a supporting region that are alternately disposed in a form of a concentric circle. In an embodiment, the photocatalyst may include at least one among $Au/TiO_2$, $TiO_2/SeO_2$, $TiO_2/SiO_2$, $TiO_2$, ZnO, $ZrO_2$, CdSe, $WO_3/TiO_2$, and $Al_2O_3/ZrO_2$. In an embodiment, the light emitted from the light irradiation part may include at least one of visible light, ultraviolet (UV) light, and infrared light.

According to another embodiment of this disclosure, a chemical mechanical polishing apparatus includes: a polishing platen; a polishing pad located on the polishing platen and including a transmissive part; a slurry supply supplying a slurry including a photocatalyst to the polishing pad; a head part located on the polishing pad and capable of mounting a wafer; and a light irradiation part for irradiating light to the head part, wherein the light irradiation part includes a plurality of regions, and an amount of light may be adjusted for each of the plurality of regions. In an embodiment, the photocatalyst may include at least one among $Au/TiO_2$, $TiO_2/SeO_2$, $TiO_2/SiO_2$, $TiO_2$, ZnO, $ZrO_2$, CdSe, $WO_3/TiO_2$, and $Al_2O_3/ZrO_2$.

In an embodiment, a plurality of regions may be at least one pattern among circular, radial, and straight. In an embodiment, the light irradiation part may include a measuring instrument controlling the amount of light, a light source of the light irradiation part may be composed of at least one unit, and the unit may receive power independently from the measuring instrument and control the amount of light. In an embodiment, the plurality of regions may include some regions having different intensities of light.

The chemical mechanical polishing apparatus according to an embodiment of this disclosure includes the light irradiation part located within the opening of the polishing platen, thereby providing the chemical mechanical polishing apparatus that may improve the reaction speed through the light reaction by accelerating the reaction with the photocatalyst included in the slurry.

The chemical mechanical polishing apparatus according to another embodiment of this disclosure includes the protection member positioned between the polishing platen and the polishing pad, thereby providing the chemical mechanical polishing apparatus that improves the reaction speed through the light reaction by promoting the reaction with the photocatalyst included in the slurry, and protects the light irradiation part.

In the chemical mechanical polishing apparatus according to another embodiment of this disclosure, the light irradiation part includes a plurality of regions and the light amount is adjusted for each of a plurality of regions, thereby providing the chemical mechanical polishing apparatus that enables targeted dispersion control.

The various and beneficial merits and effects of this disclosure are not limited to the above and will be more easily understood in the process of explaining specific embodiments of this disclosure.

DETAILED DESCRIPTION

Figure 1A:
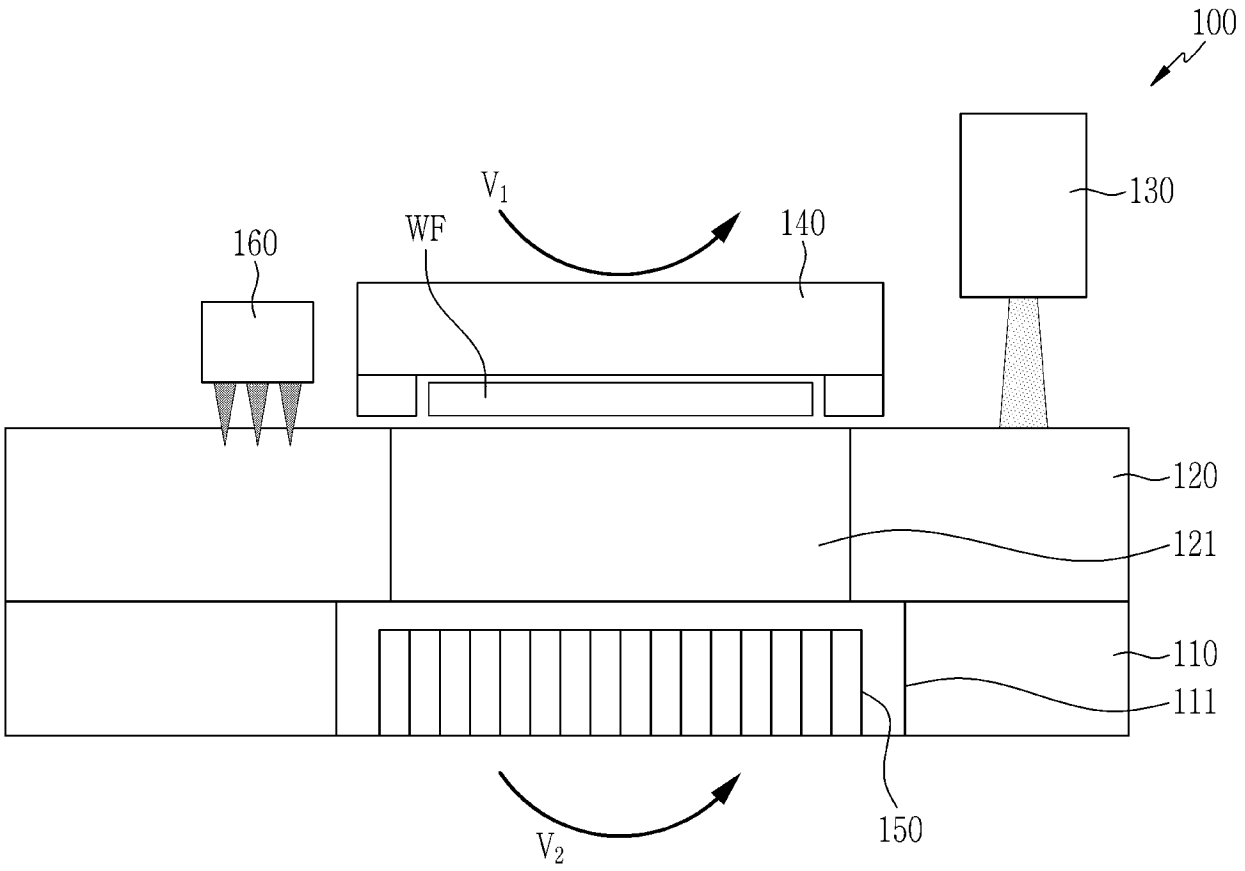
FIG. 1A is a front view of a chemical mechanical polishing apparatus according to an embodiment of this disclosure.

This disclosure will be described more fully hereinafter with reference to the accompanying drawings, in which embodiments of the disclosure are shown. As those skilled in the art would realize, the described embodiments may be modified in various different ways, all without departing from the spirit or scope of this disclosure.

In order to clarify this disclosure, parts that are not connected with the description will be omitted, and the same elements or equivalents are referred to by the same reference numerals throughout the specification.

Further, since sizes and thicknesses of constituent members shown in the accompanying drawings are arbitrarily given for better understanding and ease of description, this disclosure is not limited to the illustrated sizes and thicknesses. In the drawings, the thicknesses of layers, films, panels, regions, etc., are exaggerated for clarity. In the drawings, for better understanding and ease of description, thicknesses of some layers and areas are excessively displayed.

It will be understood that when an element such as a layer, film, region, or substrate is referred to as being "on" or "above" another element, it can be directly on the other element or intervening elements may also be present. In contrast, when an element is referred to as being "directly on" another element, there are no intervening elements present. Further, in the specification, the word "on" or "above" means located on or below the object portion, and does not necessarily mean positioned on the upper side of the object portion based on a gravitational direction.

In addition, unless explicitly described to the contrary, the word "comprise", and variations such as "comprises" or "comprising", will be understood to imply the inclusion of stated elements but not the exclusion of any other elements.

Further, in the specification, the phrase "on a plane" means when an object portion is viewed from above, and the phrase "on a cross-section" means when a cross-section taken by vertically cutting an object portion is viewed from the side.

Hereinafter, an embodiment of this disclosure will be described in detail so that a person of ordinary skill can easily practice it in the technical field to which this disclosure belongs. As those skilled in the art would realize, the described embodiments may be modified in various different ways, all without departing from the spirit or scope of this disclosure.

FIG. 1A is a front view of a chemical mechanical polishing apparatus 100 according to an embodiment of this disclosure. Referring to FIG. 1A, a chemical mechanical polishing apparatus 100 as a device for polishing a wafer WF includes a polishing platen 110, a polishing pad 120, a slurry supply 130, a head part 140, and a light irradiation part 150 that irradiates light to perform a light reaction with a photocatalyst supplied from the slurry supply 130. In the chemical mechanical polishing apparatus 100, mechanical polishing is performed as the wafer WF mounted on the lower surface of the head part 140 is in contact with the polishing pad 120, and chemical polishing is performed through a chemical reaction by the slurry supplied from the slurry supply 130. The wafer WF can be a semiconductor wafer such as silicon, or a light transmissive wafer such as glass, quartz or sapphire. The substrate to be polished need not be in wafer form and can be a rectangular or other type of substrate, e.g. a metal or ceramic substrate to be polished.

The polishing platen 110 is a member for mounting the polishing pad 120 and, for example, may be configured in a disc shape. The polishing platen 110 may include a polishing platen rotation shaft (110 in FIG. 4A), or may be composed of a rotation shaft, which applies rotation energy, so that the polishing pad 120 rotates in a certain direction.

The polishing pad 120 may be positioned on the polishing platen 110 and may be a rotatable member. Specifically, the polishing pad 120 uniformly planarizes the surface of the wafer WF, and may be a member that performs the mechanical polishing.

In an embodiment, the polishing pad 120 may be, as a non-limiting example, a hard-polyurethane pad. In an embodiment, the polishing pad 120 may include a transmissive part 121 in which at least a part of the region through which light irradiated to the wafer WF polishing layer from the light irradiation part 150 penetrates is transparent. Specifically, light irradiated from the light irradiation part 150 may pass through the transmissive part 121 and reach the wafer WF mounted on the polishing pad 120. More specifically, the transmissive part 121 may be a member that assists light irradiated from the light irradiation part 150 to be transmitted so as to reach the polishing layer of the wafer WF.

In an embodiment, the transmissive part 121 may have a concentric circular (or spiral) shape in consideration of the rotation of the polishing pad 120. The diameter of the transmissive part 121 may be greater than the diameter of the wafer WF. If the diameter of the transmissive part 121 is smaller than the diameter of the wafer WF, it is not easy to irradiate light to the entire surface of the polishing layer of the wafer WF, and the light reaction proceeds locally, which makes it difficult to control the distribution.

The slurry supply 130 is positioned on the polishing pad 120, and may supply the slurry to the polishing pad 120. Specifically, the slurry supply 130 may be a member that selectively supplies the slurry to the center of the polishing pad 120 so as to perform chemical polishing to uniformly planarize the surface of the wafer WF.

In an embodiment, the slurry supply 130 may supply the slurry including a photocatalyst to the polishing pad 120. In an embodiment, the photocatalyst may include, for example, at least one among Au/$TiO_2$, $TiO_2$/$SeO_2$, $TiO_2$/$SiO_2$, $TiO_2$, ZnO, $ZrO_2$, CdSe, $WO_3$/$TiO_2$, and $Al_2O_3$/$ZrO_2$. The photocatalyst may be activated by the light irradiated from the light irradiation part 150 described later.

The head part 140 may be a rotatable member located above the polishing pad 120 and holding the wafer WF. Specifically, the head part 140 has a disk shape having a smaller diameter than the polishing pad 120, and the wafer WF may be mounted on the head part 140. More specifically, the wafer WF mounted on the head part 140 is in contact with and rotates with the polishing pad 120, thereby the mechanical polishing is performed, and the chemical polishing is performed by using the slurry supplied from the slurry supply 130, so that chemical mechanical polishing may be performed.

In an embodiment, the head part 140 is a rotatable member and may be rotatable through a first controller (not shown). For example, the first controller may make the wafer WF mounted on the head part 140 rotatable, specifically, a central shaft of the head part 140 rotatable, thereby making the head part 140 rotatable.

The light irradiation part 150 may be a member for irradiating light to the polishing layer of the wafer WF. In an embodiment, light irradiated from the light irradiation part 150 may pass through the transmissive part 121 and reach the wafer WF mounted on the head part 140.

In an embodiment, the polishing platen 110 may include an opening 111. The light irradiation part 150 is disposed in a predetermined space provided inside the polishing platen 110, for example, the opening 111, and may operate independently with the polishing platen 110. In another embodiment, when the polishing platen 110 is composed of a rotating part (referring to FIG. 4A, 110) mounted on the central shaft, the light irradiation part 150 and the polishing platen 110 may be spaced apart and disposed proximate to each other.

The light irradiation part 150 may include a light source such as an LED to irradiate the light. In an embodiment, the light source may consist of at least one unit. The unit may be, for example, a pixel that emits light within the light irradiation part 150.

In an embodiment, the light emitted from light irradiation part 150 may include at least one of visible light, ultraviolet (UV) light, and infrared light. For example, the light may be visible light or ultraviolet (UV) light.

In an embodiment, the light irradiation part 150 emits light and may be a rotatable member. In an embodiment, the light irradiation part 150 is a rotatable member, which may be rotatable through a second controller (not shown). For example, the light irradiation part 150 may be rotatable by the central shaft by the light irradiation part 150 so that a light source such as an LED within the light irradiation part 150 may be rotatable.

In an embodiment, the first controller and the second controller may rotatably control the head part 140 and the light irradiation part 150 with the same speed V1 and V2, respectively. (First speed V1 and second speed V2 can also be different from each other.) In an embodiment, the head part 140 and the light irradiation part 150 may be rotated in the same direction. As the head part 140 and the light irradiation part 150 are rotated with the same speed, the wafer WF and the LED module in the light irradiation part 150 face the same region, it is possible to uniformly polish the surface of the wafer WF by suppressing an asymmetric distribution.

In an embodiment, the polishing pad 120 may rotate, and the rotation of the polishing pad 120 and the light irradiation part 150 may be controlled by different controllers. In an embodiment, the rotations of the polishing pad 120, the head part 140, and the light irradiation part 150 may be controlled by different controllers. For example, the rotations of the light irradiation part 150, the head part 140, and the polishing pad 120 may be controlled by first, second, and third controllers, respectively. In an embodiment, the rotation direction of the polishing pad 120 rotated by the polishing platen 110 and the rotation direction of the head part 140 may be the same or different.

Figure 6:
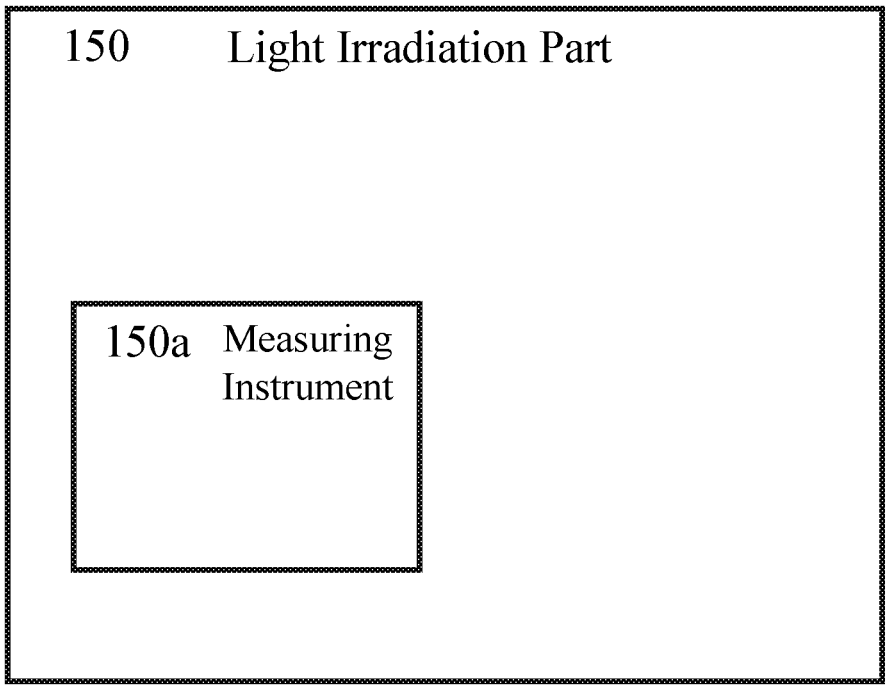
FIG. 6 is a block diagram of a light irradiation part pattern including a Measuring Instrument according to an embodiment of this disclosure.

In an embodiment, the light irradiation part 150 may control the amount of light being irradiated. Specifically, the light irradiation part 150 may include a measuring instrument 150*a* (see FIG. 6) for controlling the amount of light. The measuring instrument 150*a* is separately disposed from the light irradiation part 150, and for example, it may supply power to each pixel of the LED light source to emit light. In an embodiment, the pixel in the light irradiation part 150 may be configured as part of a plurality of pixels, and the light amount of the pixels may be controlled by the measuring instrument 150*a*. The measuring instrument 150*a* is a non-limiting example, and various methods that may control the amount of light of the pixel may be used.

In an embodiment, at least one pixel may be independently driven. For example, at least one pixel may independently receive the power from the measuring instrument and control the amount of light of each pixel. By independently driving at least at least one pixel, it is possible to control the intensity of the region where the photocatalyst is activated, thereby facilitating the dispersion control. In an embodiment, the light irradiation part may include a plurality of regions, and the amount of light may be adjusted for each of the plurality of regions. The content of adjusting the amount of light for each of the plurality of regions is described later in FIG. 5A to FIG. 5E.

In an embodiment, a conditioner 160 may be further included on the polishing pad 120. The conditioner 160 may be a member that conditions the surface of the polishing pad 120. Specifically, the conditioner 160 may maintain the polishing pad 120 in an optimal state by restoring pad planarity and/or surface roughness of the surface of the polishing pad 120.

In an embodiment, the conditioner 160 may restore or maintain the surface roughness of the polishing pad 120 by controlling the roughness of the polishing pad 120 during the polishing of the wafer WF with the head part 120 or in a state where the polishing of the wafer WF is stopped. In an embodiment, the conditioner 160 may be configured by fixing particles for the polishing, for example, artificial diamond particles, by using a nickel (Ni) adhesive layer as a medium on a circular disk made of a metal. In an embodiment, the conditioner 180 may rotate in a certain direction. For example, the conditioner 180 may control the roughness of the polishing pad 130 while rotating in a clockwise direction.

In an embodiment, a cleaning solution supply nozzle (not shown) for supplying a cleaning solution to remove an impurity remaining on the polishing pad 120 may be further included. Like the slurry described above, the cleaning solution supplied through the cleaning solution supply nozzle may be uniformly supplied while gradually moving from the center position of the polishing pad 120 to the edge portion.

Figure 1B:
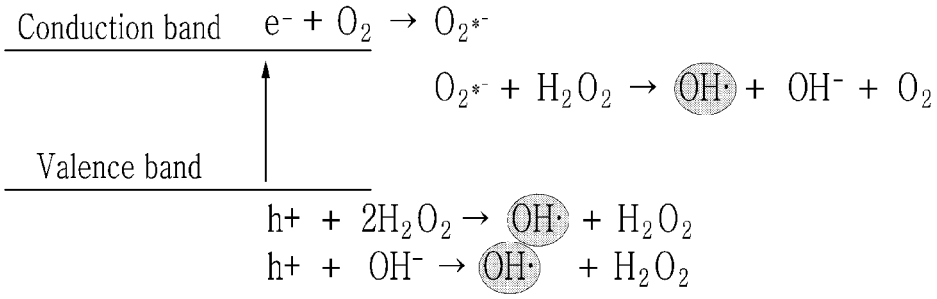
FIG. 1B is a view showing a mechanism related to a light reaction according to an embodiment of this disclosure.

FIG. 1B is a view showing a mechanism related to a light reaction according to an embodiment of this disclosure. This light activated reaction as illustrated in FIG. 1B is but one example and other suitable types of light activated reactions are possible. Referring to FIG. 1B, the photocatalyst supplied from the slurry supply 130 reacts with the light irradiated from the light irradiation part 150 to perform the light reaction, and the polishing speed of the polishing layer of the wafer WF may be controlled by the light reaction. Specifically, in the light reaction, as disclosed in FIG. 1B, when a material such as a photocatalyst is irradiated with light, an electron ($e^-$) and a hole ($h^+$), which is a particle that behaves like an electron with a charge, are created, and the electron reacts with oxygen on the surface of the photocatalyst to generate a superoxide negative ion ($O_2^-$). The hole reacts with moisture present in air to generate a hydroxyl radical (neutral OH). The hydroxyl radical may oxidize strong organic materials and may improve a wafer polishing speed by acting as an abrasive.

For example, when the light source irradiated from the light irradiation part 150 is visible light, at least one of $Au/TiO_2$, $TiO_2/SeO_2$, and $TiO_2/SiO_2$ may be used as the photocatalyst. When the light source produces ultraviolet (UV) light, at least one of $TiO_2$, ZnO, $ZrO_2$, CdSe, $WO_3/TiO_2$, and $Al_2O_3/ZrO_3$ may be used as the photocatalyst.

In an embodiment, at least some of the photocatalyst in the slurry may be the abrasive. For example, by including the abrasive in addition to the photocatalyst in the slurry, the photocatalyst and the abrasive may be simultaneously used as an abrasive to increase the polishing speed, or only the photocatalyst may be used as the abrasive in the slurry. In this way, by including the photocatalyst in the slurry, it is possible to improve the polishing speed of the polishing layer of the wafer WF and to easily control the dispersion through the light reaction with the light irradiated from the light irradiation part 150.

The abrasive can be any suitable abrasive for the surface being polished. The abrasive can be aluminum oxide, cerium oxide, chromium oxide, silica, silicate, silicon carbide, zirconia, boron carbide, tin oxide, tungsten carbide, or other suitable abrasive. In addition to the abrasive, the slurry may further comprise one or more of an acid, water, an oxidant (e.g., hydrogen peroxide), an inhibitor, a surfactant, and a base among other potential suitable components.

Figure 2A:
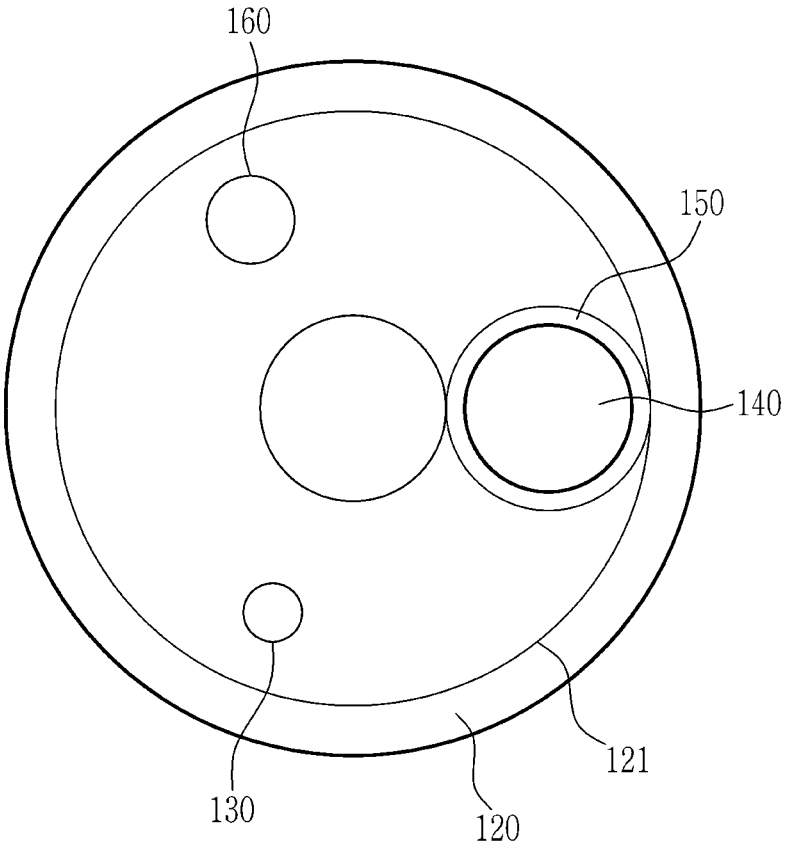
FIG. 2A and FIG. 2B are top plan views of a chemical mechanical polishing apparatus according to an embodiment of this disclosure.
Figure 2B:
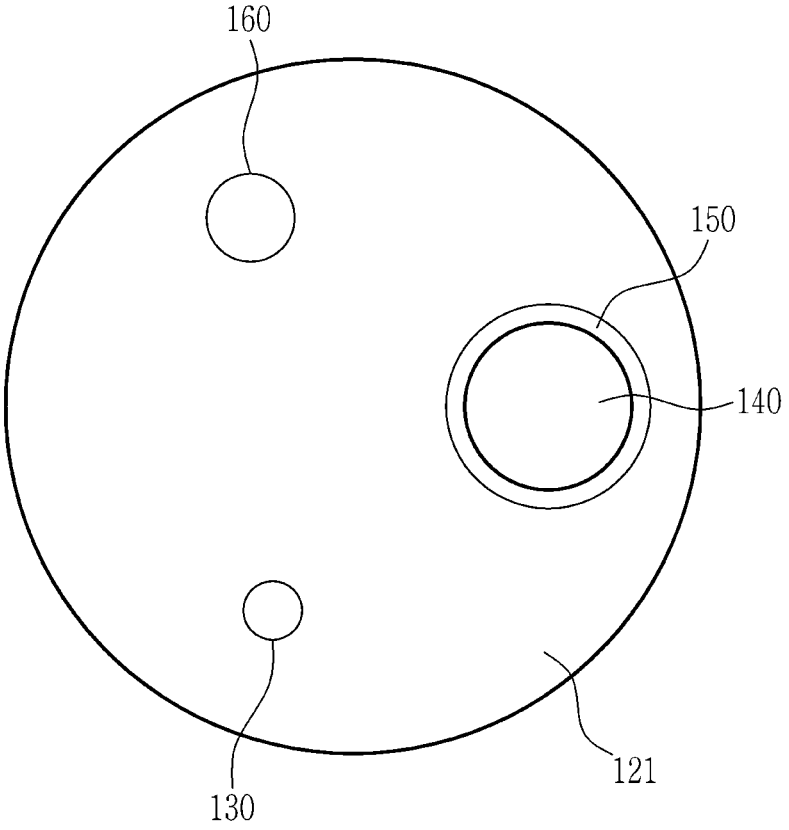

FIG. 2A and FIG. 2B are top plan views of a chemical mechanical polishing apparatus according to an embodiment of this disclosure.

FIG. 2A is a top plan view for the chemical mechanical polishing apparatus 100 in FIG. 1A. The polishing pad 120 of the chemical mechanical polishing apparatus 100 may include a transmissive part 121 in which at least a part of the region through which light irradiated to the polished layer of the wafer WF from the light irradiation part 150 penetrates is transparent. For example, in the transmissive part 121, a transparent member having a longer length than the diameter of the wafer WF may be implemented in a concentric circle shape so that light irradiated from the light irradiation part 150 may be irradiated to the entire surface of the wafer WF.

FIG. 2B shows that the polishing pad 120 is entirely composed of a transparent member. For example, the transmissive part 121 in the polishing pad 120 may constitute the entire polishing pad 120. In this way, since the entire polishing pad 120 is composed of a transparent member, a part of the light irradiated from the light irradiation part 150 may be scattered to a region other than the wafer WF being polished. In this way, some of the scattered light may partially react with the photocatalyst in the slurry, and as the photocatalyst reacts in a wider region, the polishing speed of the wafer WF may be improved.

Figure 3:
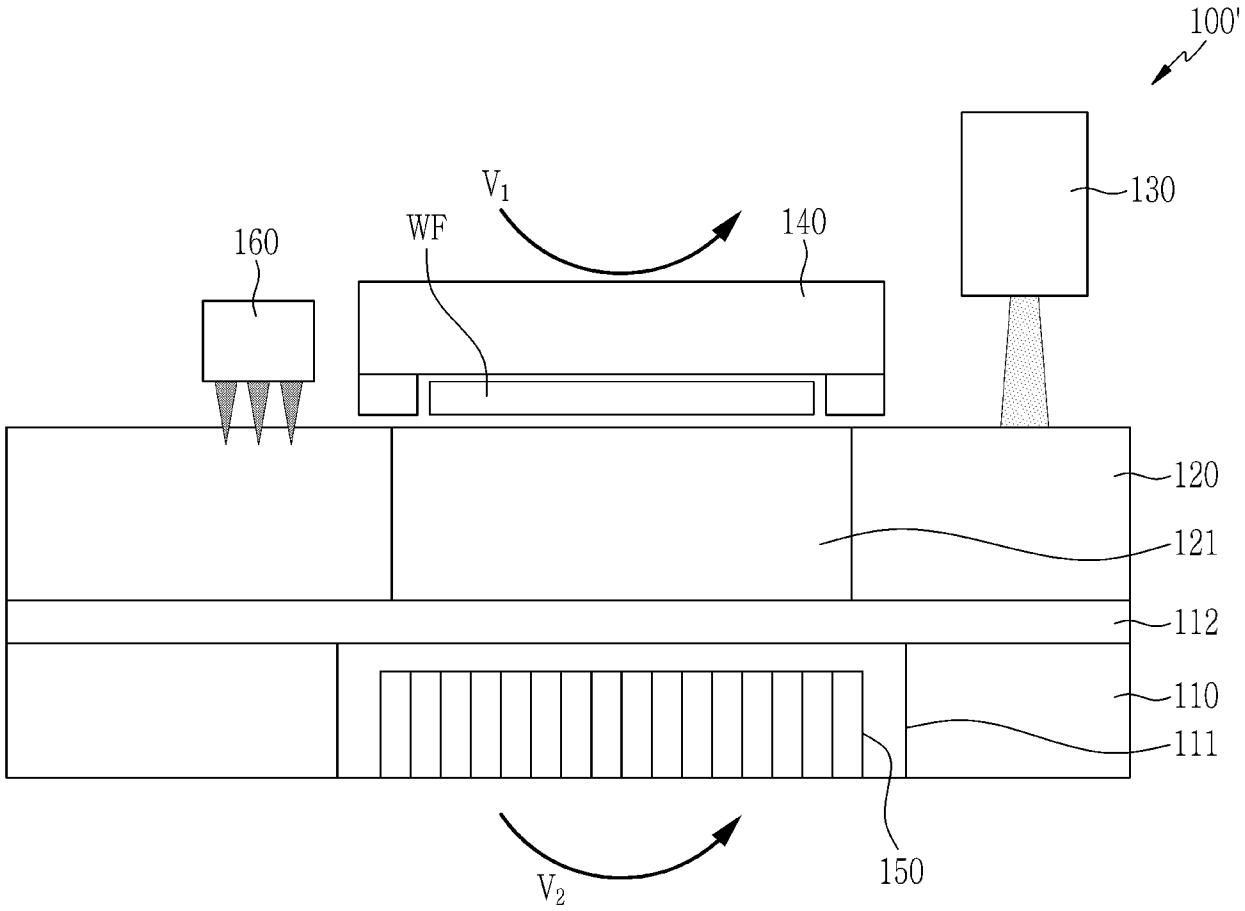
FIG. 3 is a front view of a chemical mechanical polishing apparatus according to another embodiment of this disclosure.

FIG. 3 is a front view of a chemical mechanical polishing apparatus 100 according to another embodiment of this disclosure. Referring to FIG. 3, a chemical mechanical polishing apparatus 100' according to another embodiment of this disclosure may include a polishing platen 110 including an opening 111, a polishing pad 120 positioned on the polishing platen 110 and including a transmissive part 121 overlapping the opening 111, a slurry supply 130 supplying the slurry including the photocatalyst to the polishing pad 120, a head part 140 positioned on the polishing pad 120 and capable of mounting the wafer, and a protection member 112 including a light irradiation part 150 positioned in the opening 111 of the polishing platen 110 and positioned between the polishing platen 110 and the polishing pad 120. The detailed descriptions of the polishing platen 110, the polishing pad 120, the slurry supply 130, the head part 140, and the light irradiation part 150 are the same as those of FIG. 1A in a range that does not contradict.

In an embodiment, the chemical mechanical polishing apparatus 100' may include the protection member 112 positioned between the polishing platen 110 and the polishing pad 120. The protection member 112 may be a member for improving the adherence between the polishing platen 110 and the polishing pad 120.

Specifically, the protection member 112 is disposed on the polishing platen 110, and may be disposed on the light irradiation part 150. The protection member 112 may be a member for protecting the light irradiation part 150. In an embodiment, the entire protection member 112 may be transparent. In an embodiment, the protection member 112 may be disposed between the polishing platen 110 and the polishing pad 120 in a circular shape. As a non-limiting example, the protection member 112 is a member capable of protecting the light irradiation part 150 and may have a layered structure of various shapes.

Figure 4A:
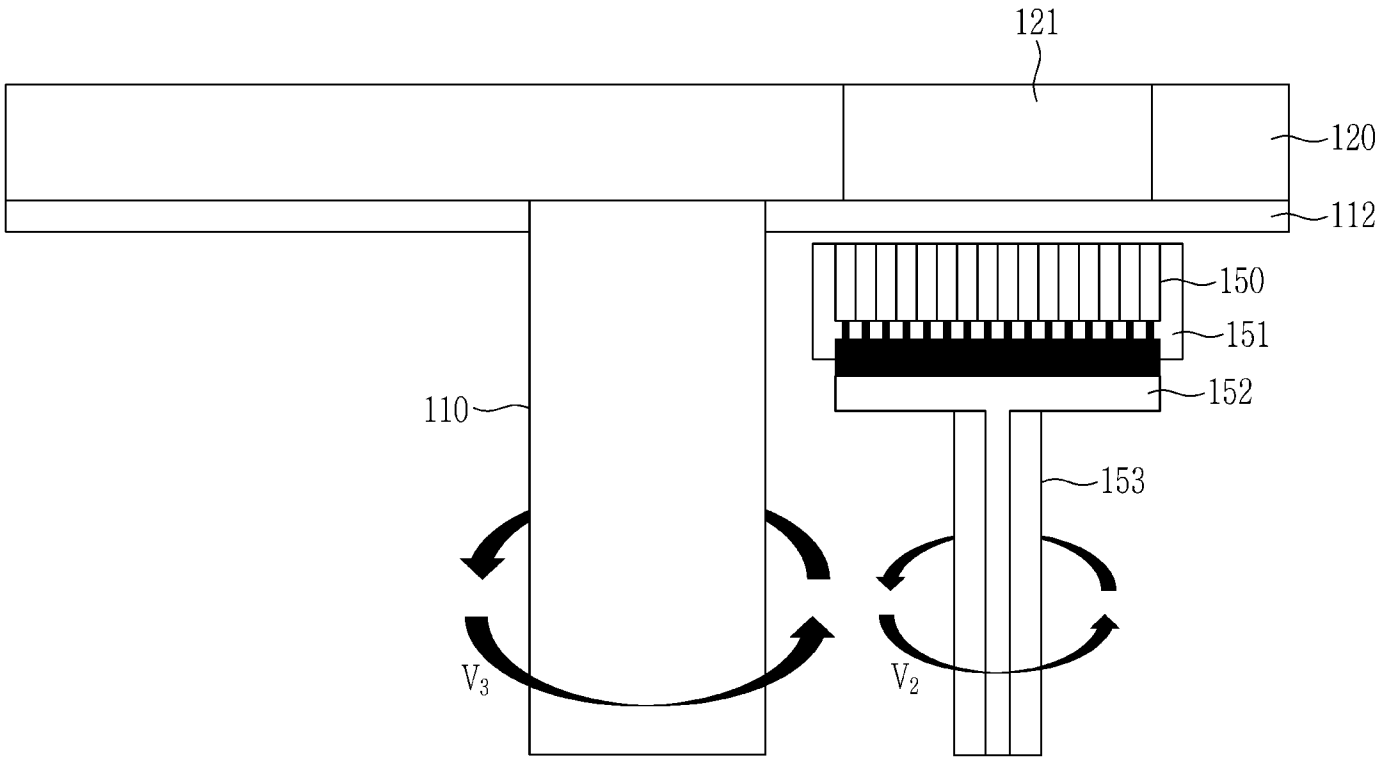
FIG. 4A to 4C are front views of a chemical mechanical polishing apparatus including a transparent layer or a supporting part according to an embodiment of this disclosure.
Figure 4B:
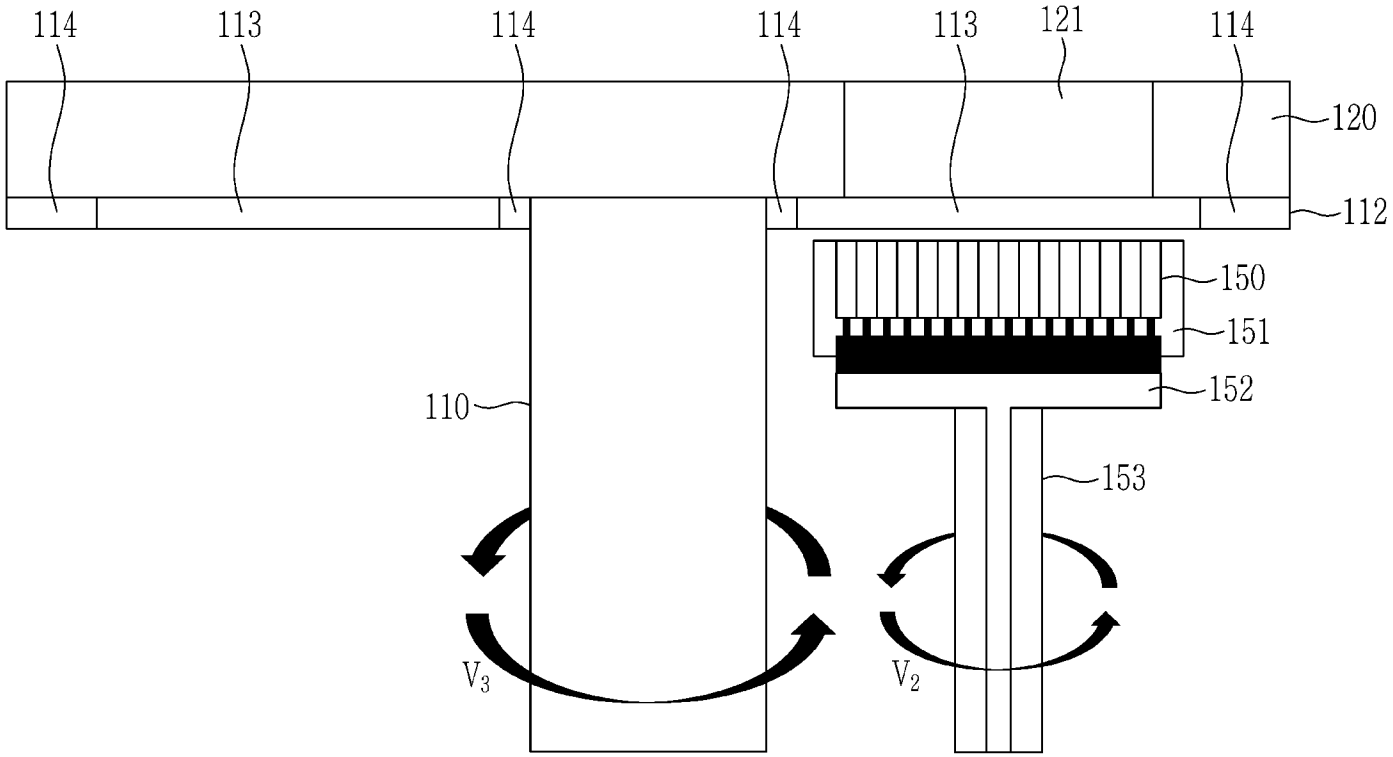
Figure 4C:
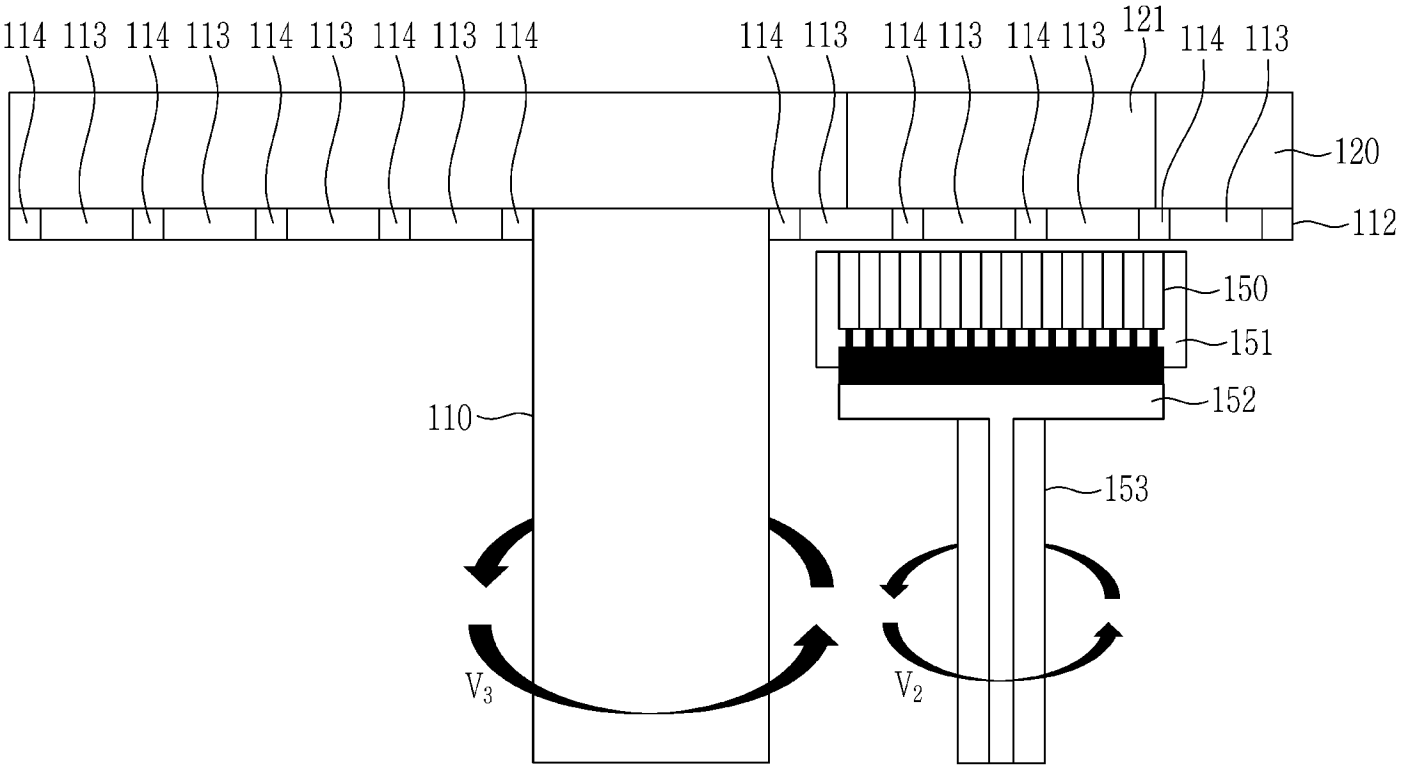
Figure 4D:
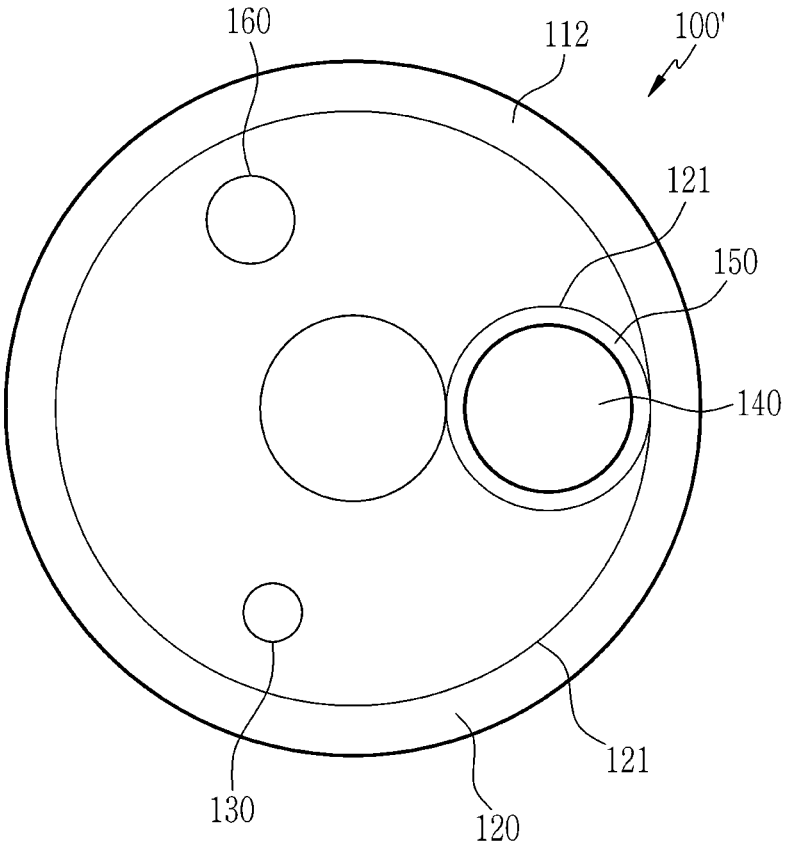
FIG. 4D and FIG. 4E are top plan views of a chemical mechanical polishing apparatus according to an embodiment of this disclosure.
Figure 4E:
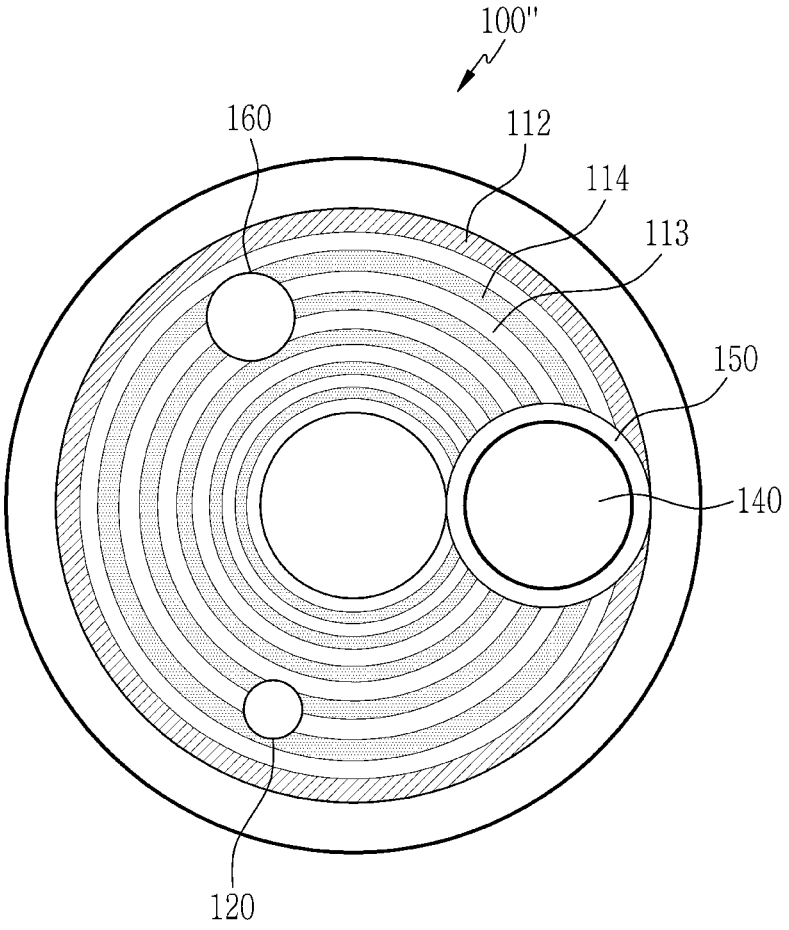

FIG. 4A to 4C are front views of a chemical mechanical polishing apparatus 100' and 100" including a protection member 112, and transmissive regions 113 and 114 according to an embodiment of this disclosure, and FIG. 4D and FIG. 4E are top plan views of chemical mechanical polishing apparatuses 100' and 100" according to an embodiment of this disclosure.

FIG. 4A is a front view of the chemical mechanical polishing apparatus 100' of FIG. 3. Referring to FIG. 4A, the protection member 112 is disposed between the polishing platen 110 and the polishing pad 120, thereby protecting the upper part of the light irradiation part 150. FIG. 4A shows only the rotating member that rotates the polishing platen 110 with the polishing platen 110, but this does not limit this disclosure, and as shown in FIG. 3, the case where the light irradiation part 150 is disposed inside the polishing platen 110 of the pad shape may also be included.

In an embodiment, the light irradiation part 150 may include the light irradiation part supporter 151. The light irradiation part supporter 151 may be a member for protecting or supporting the light source such as an LED. In an embodiment, the light irradiation part 150 may include a slip ring 152. The slip ring 152 may be a member for preventing the light source from being separated when the light irradiation part 150 rotates.

In an embodiment, the light irradiation part 150 may include a rotating part 153. The rotating part 153 may be a member for rotating the light irradiation part 150. The rotating part 153 may be implemented with a column shape with the central shaft of the light irradiation part 150 as a reference. In an embodiment, the speed of the rotating part 153 may be controlled by the aforementioned second controller.

Referring to FIG. 4B, in an embodiment, a supporting region 114 may be included in at least some regions within the protection member 112.

The supporting region 114 is disposed in some regions within the protection member 112 and may be a member for preventing the protection member 112 from being damaged as the load of the polishing pad 120 is applied to the protection member 112. In an embodiment, at least one supporting region 114 may be disposed in a region other than a region to which light is irradiated from the light irradiation part 150. In this way, the supporting region 114 does not interfere with light irradiation of the light irradiation part 150, and the damage to the protection member 112 may be prevented.

Referring to FIG. 4C, in an embodiment, the supporting region 114 has a concentric circle shape, and at least one concentric circle shape may be spaced apart and disposed. Specifically, at least one supporting region 114 is spaced apart from each other and disposed, thereby preventing the protection member 112 from being damaged. In an embodiment, the supporting region 114 is disposed with at least one concentric circle shape spaced apart, thereby controlling the region where the light reaction of the wafer WF is performed. For example, at least one supporting region 114 of the concentric circle shape may be disposed adjacent the light irradiation part 150, so that the region where the light irradiated from the light irradiation part 150 reaches the polished layer of the wafer WF and the region where light does not reach it may be controlled, and accordingly, the photoreaction region may be controlled.

FIG. 4D is a layout view of the chemical mechanical polishing apparatus 100 of FIG. 4A. In an embodiment, when the protection member 112 has a circular layered structure, the diameter of the protection member 112 may be greater than the diameter of the polishing pad 120. In another embodiment, the diameter of the protection member 112 may be smaller than the diameter of the polishing pad 120. In this way, the protection member 112 is disposed on the light irradiation part 150 and the size is irrelevant as long as it has a shape capable of preventing the damage to the light irradiation part 150. Again referring to FIG. 4D, the supporting part 112 may be disposed in the region that does not interfere with the light irradiation of the light irradiation part 150.

FIG. 4E is a layout view of a chemical mechanical polishing apparatus 100 of FIG. 4C. In an embodiment, the protection member 112 may be a shape in which a transmissive region 113 and a supporting region 114 are spaced apart from each other and disposed alternately in a form of the concentric circles of the different sizes. Accordingly, the damage to the light irradiation part 150 may be prevented, and the pattern of the light reaction region may be simultaneously controlled.

FIG. 5A to FIG. 5E are top plan views of a light irradiation part pattern of a chemical mechanical polishing apparatus according to an embodiment of this disclosure.

Referring to FIG. 5A to FIG. 5E, a chemical mechanical polishing apparatus 100''' according to another embodiment of this disclosure may include a polishing platen 110, a polishing pad 120 positioned on the polishing platen 110 and including a transmissive part 121, a slurry supply 130 supplying the slurry including the photocatalyst to the polishing pad 120, a head part 140 positioned on the polishing pad 120 and capable of mounting the wafer, and a light irradiation part 150 irradiating light to the head part 140, and the light irradiation part 150 may control a light amount. The detailed description of the polishing platen 110, the polishing pad 120, the slurry supply 130, the head part 140, and the light irradiation part 150 is the same as that of FIG. 1A in a non-contradictory range.

In an embodiment, the light irradiation part 150 includes a plurality of regions P1, P2, and P3, and may adjust the amount of light for each plurality of regions. The light irradiation part 150, as described in FIG. 1A, may include at least one pixel that is a light emitting member. The light irradiation part 150 may include at least one divided region dividing a predetermined region including the pixel.

Specifically, the light irradiation part 150 may include a measuring instrument that controls the amount of light, and the measuring instrument may control the amount of light by independently transmitting each power to the light source of the light irradiation part 150 composed of at least one unit. Accordingly, a plurality of regions P1, P2, and P3 may transmit the light amounts of the different regions to the polished layer of the wafer WF to be polished.

In an embodiment, a plurality of regions P1, P2, and P3 may include at least one pattern among a circular shape P1, a radial shape P2, a straight shape P3. For example, the patterns of the circular shape P1, the radial shape P2, and the straight shape P3 may be implemented independently, and the patterns of the circular shape P1 and the radial shape P2, the circular shape P1 and the straight shape P3, and the radial shape P2 and the straight shape P3 may be implemented in combination, while the patterns of the circular shape P1, the radial shape P2, and the straight shape P3 may all be combined and implemented.

In a plurality of regions P1, P2, and P3, the amount of light may be controlled by the above-described measuring instrument. As the amount of light is controlled by the measuring instrument, it is possible to differently control the amount of light for each of the divided regions, and then it easy to control the distribution according to the gradient of the wafer WF.

Again referring to FIG. 5A, the light irradiation part 150 may include a plurality of divided regions having a circular shape P1. The entire surface of the wafer WF polished by the light irradiation part 150 including a divided plurality of regions in the circular shape P1 may be uniformly polished.

Figure 5A:
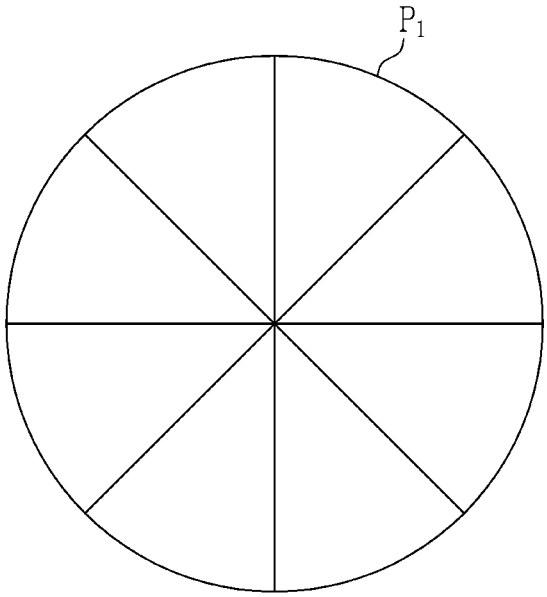
FIG. 5A to FIG. 5E are top plan views of a light irradiation part pattern of a chemical mechanical polishing apparatus according to an embodiment of this disclosure.
Figure 5B:
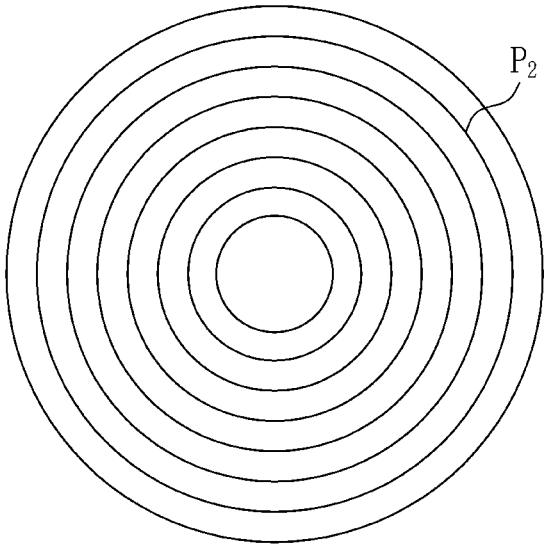

Referring to FIG. 5B, the light irradiation part 150 may include a plurality of divided regions of the radial shape P2. The wafer WF polished by the light irradiation part 150 including a plurality of regions divided into the radial shape P2 may control an asymmetric distribution and polish the wafer WF.

Figure 5C:
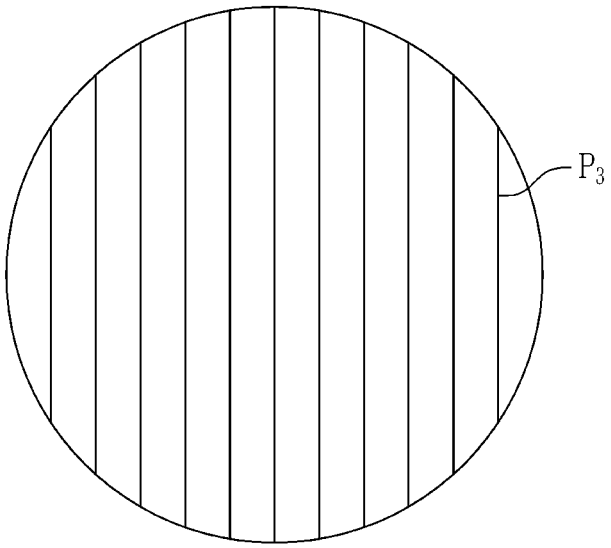

Referring to FIG. 5C, the light irradiation part 150 may include a plurality of divided regions in the form of the straight shape P3. The wafer WF polished by the light irradiation part 150 including a plurality of regions divided in the straight shape P3 may control an eccentric distribution and polish the wafer WF.

Figure 5D:
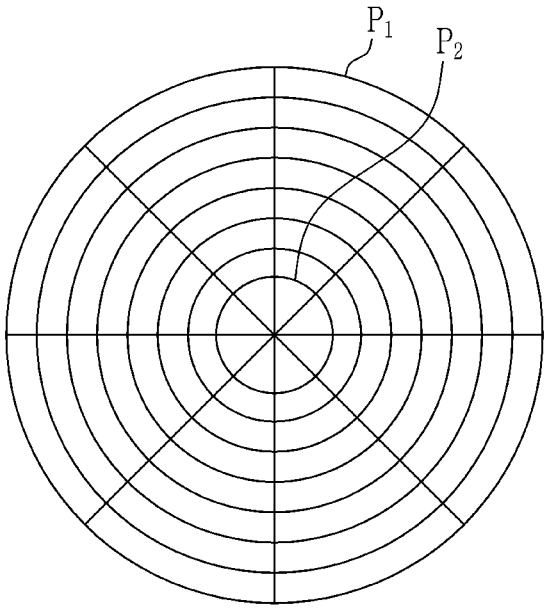

Referring to FIG. 5D, the light irradiation part 150 may be a combination of a plurality of divided regions in the form of the circular shape P1 and the radial shape P2. The wafer WF polished by the light irradiation part 150 including a divided plurality of regions in the form of the circular shape P1 and the radial shape P2 may control the asymmetric distribution and polish the wafer WF.

Figure 5E:
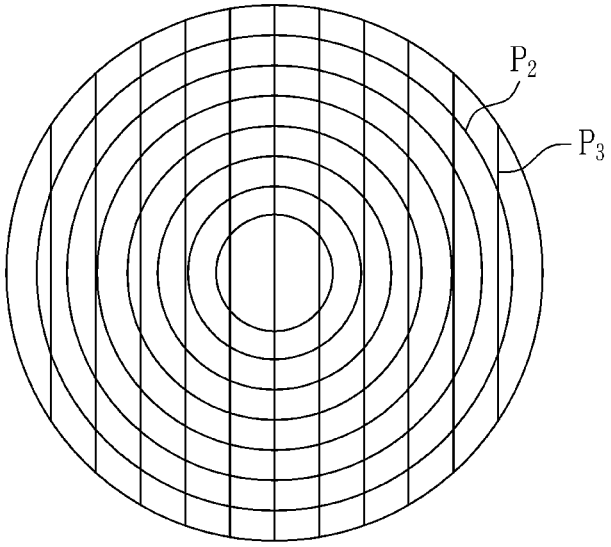

Referring to FIG. 5E, the light irradiation part 150 may be a combination of a plurality of divided regions in the form of the circular shape P1 and the straight shape P3. The wafer WF polished by the light irradiation part 150 including a plurality of divided regions in the form of the circular shape P1 and the straight shape P3 may control the eccentric distribution and polish the wafer WF.

Referring back to FIG. 5A to FIG. 5E, the light irradiation part 150 includes a plurality of patterned and divided regions, thereby controlling the amount of light and the polishing speed for each region.

As mentioned herein, if a material is "transmissive" to light, it is highly transmissive to the wavelength of light being utilized in the light irradiation part 150. The transmissivity is typically 90% or more, such as 95% or more, including 98% or more or even 99.5% or more. The material selected for any of the light transmissive parts or regions can be selected based on the light wavelength to be used in the light irradiation part. If using a UV light source, the transmissive parts can be made of UV fused silica, calcium fluoride (CaF2), magnesium fluoride (MgF2) or sapphire. For a visible light source, the transmissive parts can be made of glass, fused quartz, fused silica, sapphire, borosilicate glass, float glass, among others.

It is also possible, depending upon the CMP method being performed, to use an infrared light source and a transmissive part transmissive to infrared wavelengths. The transmissive part could be made of sapphire or different types of glass including low water content glasses such as infrasil, among other materials. For mid infrared, calcium fluoride, barium fluoride, sapphire, zinc sulfide, zinc selenide or lithium fluoride based materials among others could be used. For longwave infrared, potassium chloride, sodium chloride, magnesium oxide, silicon, germanium based materials among others could be used.

In addition to an LED light source, such as an LED providing ultraviolet or visible light (or infrared light), other light sources are possible such as a tungsten or halogen lamp, a fluorescent lamp, an arc discharge lamp, or a laser light source among others. For a UV light source, a xenon, mercury or deuterium lamps, as well as a UV laser light source, among others, is envisioned. A mix of UV and visible light could be used, such as blue light and UV light, or other combinations of UV, visible and infrared, depending upon the CMP process being performed.

This disclosure is not limited to the embodiments but may be manufactured in a variety of different forms, and those of ordinary skill in the art to which this disclosure pertains will understand that this disclosure may be implemented in other specific forms without changing the technical spirit or essential features of this disclosure. Therefore, it should be understood that the embodiments and/or embodiments described above are illustrative in all respects and not restrictive.

What is claimed is:

1. A chemical mechanical polishing apparatus comprising:

a polishing platen including an opening;

a polishing pad positioned on the polishing platen and including a light transmissive part overlapping the opening;

a slurry supply having a slurry including a photocatalyst, the slurry supply disposed so as to supply the slurry with the photocatalyst to the polishing pad;

a head part positioned on the polishing pad and capable of mounting a substrate to be polished; and a light irradiation part positioned within the opening of the polishing platen so as to direct light to the light transmissive part of the polishing pad.

2. The chemical mechanical polishing apparatus of claim 1, wherein the head part and the light irradiation part are rotatable, a rotation direction of the head part is the same as a rotation direction of the light irradiation part, and a rotation speed of the head part is the same as a rotation speed of the light irradiation part.

3. The chemical mechanical polishing apparatus of claim 2, further comprising a protection member positioned between the polishing platen and the polishing pad.

4. The chemical mechanical polishing apparatus of claim 3, wherein the protection member is transparent.

5. The chemical mechanical polishing apparatus of claim 3, wherein the protection member includes a transmissive region and a supporting region that are alternately disposed in a form of a concentric circle.

6. The chemical mechanical polishing apparatus of claim 2, wherein the light irradiation part includes a plurality of regions, and a light amount is controlled for one or more regions of the plurality of regions.

7. The chemical mechanical polishing apparatus of claim 6, wherein the plurality of regions are divided in a form of at least one of straight, circular, and radial.

8. The chemical mechanical polishing apparatus of claim 2, wherein the entire polishing pad is transparent.

9. The chemical mechanical polishing apparatus of claim 2, wherein the photocatalyst includes at least one among $Au/TiO_2$, $TiO_2/SeO_2$, $TiO_2/SiO_2$, $TiO_2$, ZnO, $ZrO_2$, CdSe, $WO_3/TiO_2$, and $Al_2O_3/ZrO_2$.

10. The chemical mechanical polishing apparatus of claim 1, wherein the light irradiated from the light irradiation part passes through the light transmissive part and reaches the substrate mounted on the head part.

11. A chemical mechanical polishing apparatus, comprising:

a polishing platen including an opening;

a polishing pad positioned on the polishing platen and including a transmissive part overlapping the opening;

a slurry supply supplying a slurry including a photocatalyst to the polishing pad;

a head part positioned on the polishing pad and capable of mounting a wafer; and a light irradiation part positioned within the opening of the polishing platen, wherein a protection member positioned between the polishing platen and the polishing pad is further included.

12. The chemical mechanical polishing apparatus of claim 11, wherein the entire protection member is transparent.

13. The chemical mechanical polishing apparatus of claim 11, wherein the protection member includes a transmissive region and a supporting region that are alternately disposed in a form of a concentric circle.

14. The chemical mechanical polishing apparatus of claim 11, wherein the photocatalyst includes at least one among $Au/TiO_2$, $TiO_2/SeO_2$, $TiO_2/SiO_2$, $TiO_2$, ZnO, $ZrO_2$, CdSe, $WO_3/TiO_2$, and $Al_2O_3/ZrO_2$.

15. A chemical mechanical polishing apparatus comprising:

a polishing platen;

a polishing pad positioned on the polishing platen and including a transmissive part;

a slurry supply supplying a slurry including a photocatalyst to the polishing pad;

a head part positioned on the polishing pad and capable of mounting a wafer; and a light irradiation part positioned so as to irradiate light to the head part, wherein the light irradiation part includes a plurality of regions, each configured to independently transmit an adjustable amount of light toward the head part.

16. The chemical mechanical polishing apparatus of claim 15, wherein the photocatalyst includes at least one among $Au/TiO_2$, $TiO_2/SeO_2$, $TiO_2/SiO_2$, $TiO_2$, ZnO, $ZrO_2$, CdSe, $WO_3/TiO_2$, and $Al_2O_3/ZrO_2$.

17. The chemical mechanical polishing apparatus of claim 15, wherein the plurality of regions have at least one pattern among circular, radial, and straight.

18. The chemical mechanical polishing apparatus of claim 15, wherein the light irradiation part includes a measuring instrument configured to control the amount of light transmitted by the light irradiation part, the light irradiation part comprises at least one light source, and the at least one light source is configured to receive power independently from the measuring instrument and controls the amount of light transmitted by the light irradiation part.

19. The chemical mechanical polishing apparatus of claim 15, wherein:

the plurality of regions include some regions having different intensities of light.

20. The chemical mechanical polishing apparatus of claim 15, wherein the polishing pad and the light irradiation part are rotatable, and rotation of the polishing pad and rotation of the light irradiation part are configured to be controlled by different controllers.

* * * * *